United States Patent [19]

Geyer et al.

[11] Patent Number: 4,846,119

[45] Date of Patent: Jul. 11, 1989

[54] FUEL INJECTION PUMP FOR A TWO-STROKE ENGINE

[75] Inventors: Werner Geyer, Waiblingen; Roland Schierling, Affalterbach, both of Fed. Rep. of Germany

[73] Assignee: Andreas Stihl, Waiblingen, Fed. Rep. of Germany

[21] Appl. No.: 231,892

[22] Filed: Aug. 12, 1988

[30] Foreign Application Priority Data

Aug. 15, 1987 [DE] Fed. Rep. of Germany ..... 3727267

[51] Int. Cl.[4] ..... F02M 37/04; F02M 59/20

[52] U.S. Cl. ..... 123/73 C; 123/496; 417/395

[58] Field of Search ..... 123/73 B, 73 C, 73 A, 123/73 AD, 496, 387; 417/213, 214, 380, 395

[56] References Cited

U.S. PATENT DOCUMENTS

| | | | |
|---|---|---|---|
| 3,913,551 | 10/1975 | Shaver | 123/73 AD |
| 4,300,509 | 11/1981 | Schechter | 123/504 |
| 4,471,278 | 9/1984 | Borst et al. | 123/73 R |
| 4,551,076 | 11/1985 | DuBois | 417/395 |
| 4,552,101 | 11/1985 | Borst et al. | 417/395 |
| 4,627,390 | 12/1986 | Antoine | 123/73 CB |
| 4,700,668 | 10/1987 | Schierling et al. | 123/73 C |
| 4,765,802 | 10/1973 | Lettermann et al. | 417/395 |

FOREIGN PATENT DOCUMENTS

| | | | |
|---|---|---|---|
| 1325670 | 3/1963 | France | 417/395 |
| 8156 | of 1910 | United Kingdom | 123/504 |

*Primary Examiner*—David A. Okonsky
*Attorney, Agent, or Firm*—Walter Ottesen

[57] ABSTRACT

A pneumatically operated fuel injection pump has a work chamber which is partitioned by a membrane into a pulse chamber and a return chamber. The pulse chamber is charged with crankcase pressure from a two-stroke engine while a counterforce is built up in the return chamber which varies with rotational speed. A counterforce is developed by means of a precise pressure control in the return chamber which makes possible a highly precise injection adapted to rotational speed. For this purpose, the return chamber is connected with an adjusting volume via a throttled flow path. In addition, a leaf spring is mounted in the return chamber and is utilized as a return spring for the membrane.

14 Claims, 3 Drawing Sheets

11'
6
3
5
4
2
1
8
9
7
12
20
10a
II
30
21
25a
47
22a
22
23
17
30a
27
29
30b
28
19
26
18
25
16
13
II
24
15
11
14

FUEL INJECTION PUMP FOR A TWO-STROKE ENGINE

FIELD OF THE INVENTION

The invention relates to a fuel injection pump for a two-stroke engine, especially for handheld portable tools such as motor-driven saws or the like. The fuel injection pump includes a pneumatic pump chamber which is partitioned by a membrane into a pulse chamber charged with the crankcase pressure and a return chamber. The membrane is connected with a pump piston guided in a pump cylinder for reciprocable movement through a pump stroke. The pump piston moves into and out of a pump chamber. A positive pressure in the pulse chamber causes the membrane connected to the pump piston to drive the latter into the pump chamber against the force of a spring. In this way, fuel is injected and fuel is drawn in by suction with the return stroke of the pump piston.

BACKGROUND OF THE INVENTION

Injection pumps driven by the crankcase pressure utilize the crankcase pressure which changes during operation of the two-stroke engine. The pressure in the crankcase is dependent upon the rotational speed and load of the two-stroke engine. An overpressure develops with a downward movement of the piston in the direction toward bottom dead center; whereas, the pressure in the crankcase drops to an underpressure with the following upward movement of the piston toward top dead center. The crankcase pressure then swings between positive and negative values with the positive values likewise increasing to a maximum with increasing speed which then remain constant up to the highest speed. The pressure oscillations lie, for example, between approximately 0.75 bar and −0.2 bar.

U.S. Pat. No. 4,700,668 discloses a fuel injection pump wherein the pulse chamber is directly charged by the pressure present in the crankcase, while a mean pressure is supplied to the return chamber. The pump piston is moved upwardly and downwardly in correspondence to the pressure changes in the crankcase and thereby injects fuel into the combustion chamber of the two-stroke engine.

The air charge for the combustion chamber is reduced at high rotational speeds of the two-stroke engine because of the increasing resistance to flow in the air channels. For this reason, the quantity of fuel should be reduced at high speeds which is intended to be achieved with the aid of the crankcase mean pressure acting in the return chamber. However, this solution is not itself adequate to adapt the pumped quantity of fuel with sufficient accuracy to the rotational speed.

The spring which returns the membrane is configured as a helical spring which leads to a fuel injection pump which must be constructed so as to be large in the longitudinal direction of the pump piston.

SUMMARY OF THE INVENTION

It is an object of the invention to provide an injection pump which can be constructed so as to be small and to provide with simple means a highly precise adaptation of the fuel quantity to the air quantity supplied to the combustion chamber in dependence upon rotational speed.

The fuel injection pump of the invention is for a two-stroke engine, especially for handheld portable tools such as motor-driven saws or the like. The engine has a piston and a cylinder conjointly defining a combustion chamber and has a crankcase wherein pressure is developed in response to the movement of the piston. The fuel injection pump according to the invention includes: a housing defining an enclosed work space; a membrane partitioning the work space into a pulse chamber and a return chamber; a pump chamber arranged in the housing; fuel supply means connected to the pump chamber for supplying fuel to the latter; fuel metering line means for conducting the fuel from the pump chamber to the engine; a pump cylinder communicating with the pump chamber; a pump piston connected to the membrane and being slideably mounted in the cylinder so as to be reciprocally movable through a piston stroke away from a start position and back to the start position; a connecting line connecting the pulse chamber to the crankcase for charging the pulse chamber with the pressure present in the crankcase for actuating the membrane to develop an actuating force for driving the pump piston into the pump chamber to pump the fuel therein through the fuel metering line means and withdrawing the pump piston away from the pump chamber to draw in a fresh quantity of fuel from the fuel supply means; counterpressure means for generating a counterpressure in the return chamber for changing the piston stroke in dependence upon the rotational speed of the engine thereby changing the quantity of fuel pumped from the pump chamber; and, leaf spring means arranged in the return chamber for resiliently biasing the pump piston toward the start position.

The throttled flow path to the adjusting volume is so dimensioned that it only becomes effective at high flow speeds, that is, at high rotational speeds of the engine with rapid movements of the membrane. This is accompanied with a build-up of a counterpressure in the return chamber with increasing speed which limits the stroke of the pump piston by neutralizing the actuating force acting in the pulse chamber.

This counterpressure is dependent upon the relationship between the total volume of the return chamber and the stroke volume defined by the membrane during its stroke. If the return chamber is very large, then only low pressures are built up. On the other hand, if the return chamber is very small, then large pressures are built up. If the return spring of the membrane is mounted in the return chamber, then a reduced size for the injection pump is obtained; however, the return chamber itself must be very large with respect to its volume.

According to a feature of the invention, a leaf spring is provided in the return chamber by means of which the volume of the return chamber is held very small so that a very large counterforce can be built up through the throttled flow path at increasing speed. The leaf spring is securely braced in the housing at the foot points of its first and second narrow end faces. The center portion of the leaf spring lies in contact engagement with the lower face of the membrane. With a central loading of the leaf spring, the spring presses inwardly in the center and is in contact engagement with the membrane starting at the center and increases with distance therefrom. The leaf spring is made to lie against the membrane over almost its entire length by a bending out the leaf spring end portions. This kind of leaf spring, which is securely braced at both its ends and in the form of an arcuate spring, makes possible very large counterforces even with leaf springs of small size and strokes of reduced length and constitutes a counterweight to the deviating crankcase pressure in the pulse chamber. The volume of the return chamber can be made very small notwithstanding the return spring mounted therein because the leaf spring is itself made small so that on the one hand, a small injection pump is obtained while, on the other hand, a high counterforce is provided at increasing rotational speed.

According to a further embodiment of the invention, at least one foot point of the leaf spring is configured so as to be displaceable toward the other foot point thereof whereby a sensitive adjustment of the injection pump to the particular two-stroke engine is made possible. For this purpose, the displacement of one of the foot points is adequate; however, the displacement of both foot points can be preferable in certain individual cases.

Preferably, the foot points are disposed in abutment angles defining respective bearings so that the abutment angles can be made of high quality steel which can take up the high loads imparted to the foot points without fatiguing.

Transverse forces imparted to the pump piston attached to the membrane can lead to an intense loading of its guide in the pump cylinder. In order not to introduce these transverse forces, the leaf spring in its start position is configured so as to be symmetrical to the longitudinal axis of the pump piston.

The leaf spring has a center longitudinal portion with which it lies against the membrane so as to be displaceable preferably in the longitudinal direction and for this purpose the leaf spring has a preferably central symmetrical slot through which the shaft of the pump piston extends. With this configuration, transverse forces have no substantial effect on the shaft of the piston when an adjustment of at least one of the foot points causes a changed adjustment of the leaf spring by means of a displacement of the latter.

In order to configure the leaf spring itself still smaller with respect to its dimensions, a further embodiment of the invention provides that a flat spring is mounted in the pulse chamber and is connected with the membrane and the pump piston shaft. The flat spring is so configured that it itself delivers the substantial portion of the counterforce to be provided while the leaf spring mounted in the return chamber must provide only a portion of the counterforce which is available for a precise adjustment of the injection pump to the two-stroke engine. By means of this separation of forces, the leaf spring can be significantly reduced with respect to its dimensions and the bearings at its foot points can be configured so as to take up correspondingly lower loading forces. According to a still further embodiment of the invention, the flat spring can be configured as a resilient steel membrane replacing the rubber membrane with a steel membrane now separating the pulse chamber from the return chamber.

BRIEF DESCRIPTION OF THE DRAWINGS

The invention will now be described with reference to the drawings wherein.

DESCRIPTION OF THE PREFERRED OF THE INVENTION

Figure 1:
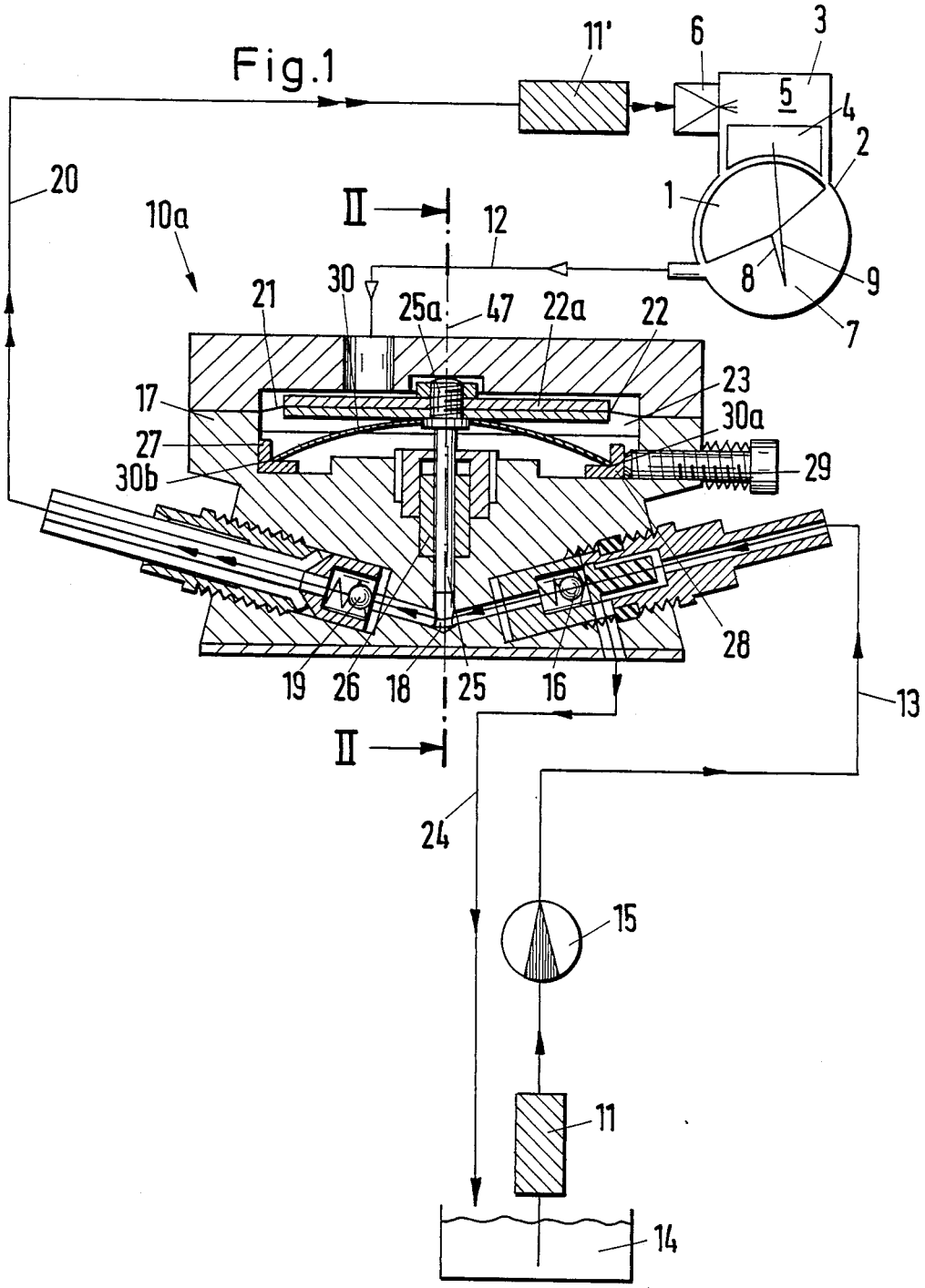
FIG. 1 is a schematic of the fuel injection arrangement equipped with a fuel pump according to a preferred embodiment of the invention with the pump shown in section.

The fuel injection arrangement shown in FIG. 1 is provided for a two-stroke engine 2 which in especially for handheld portable tools such as a handheld portable motor-driven saw and the like. The two-stroke engine includes a cylinder 3, a piston 4, a combustion chamber 5, a fuel-injection nozzle 6, a crankcase 7 as well as a crankshaft 8 and a connecting rod 9 for the piston 4. The pressure in the crankcase 7 changes with the upward and downward movements of the piston 4 during operation of the two-stroke engine 2. The pressure increases during the downward movement of the piston 4 from top dead center to approximately bottom dead center so that an overpressure develops in the crankcase. This overpressure then drops to an underpressure during the upward movement of the piston 4.

The fuel injection arrangement shown in FIG. 1 includes an injection pup 10 having a connecting line 12 which is connected to the crankcase 7 and conducts the pressure present in the crankcase to the fuel injection pump 10. A fuel metering line 13 is connected to the fuel pump 10. Fuel is pumped to an intake valve 16 through fuel metering line 13 via a fuel filter 11 from a tank 14 by means of a feed pump 15. The intake valve 16 is configured as a check valve. The feed pressure is adjusted so that the intake valve 16 does not open. Fuel which is not drawn in by suction is directed back into the tank 14 via the return line 24.

The intake valve 16 is located on one side of a pump chamber 18 built into the housing 17 of the fuel injection pump 10; whereas, an outlet valve 19 is mounted on the opposite side and is likewise configured as a check valve. A fuel injection line 20 runs from this outlet valve 19 via a further fuel filter 11' to the fuel injection nozzle 6 to the two-stroke engine 2.

The connecting line 12 leading away from the crankcase 7 leads to a pulse chamber 21 of the fuel injection pump 10. The pulse chamber 21 is separated from an adjacent return chamber 23 by means of a membrane 22. The pulse chamber 21 and the return chamber 23 conjointly defining the drive chamber of the fuel injection pump.

Figure 2:
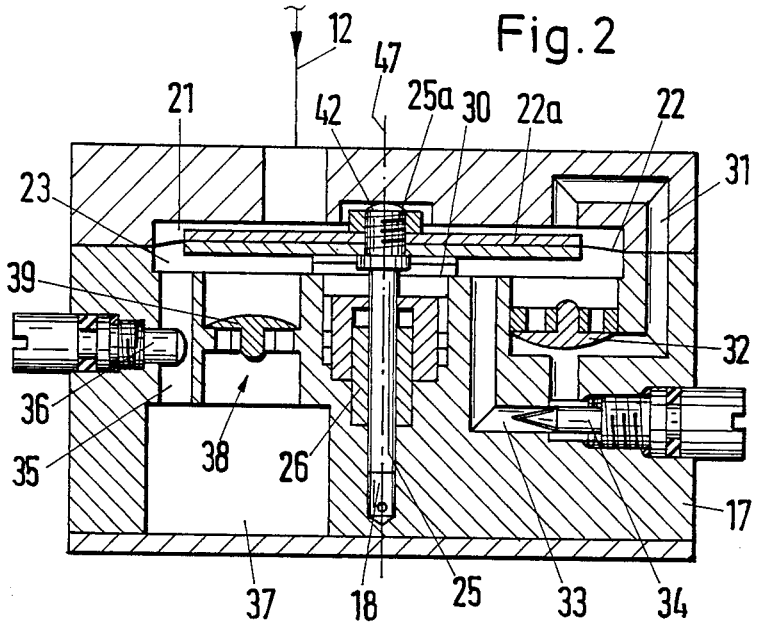
FIG. 2 is a section view of the fuel pump taken along line II—II of FIG. 1 and rotated through 90°.

A pump piston 25 is attached to the membrane 22 at the center thereof and is journalled in a guide bore 26 (pump cylinder) of the housing 17 so as to be reciprocally movable in the axial direction. The membrane 22 is biased into its upper initial position (FIGS. 1 and 2) by means of a return spring 30. In order to reduce the movable mass, the membrane plate is configured to have appropriate weight saving cutouts. The membrane plate can, in this way, follow rapid changes in pressure without difficulty.

Figure 3:
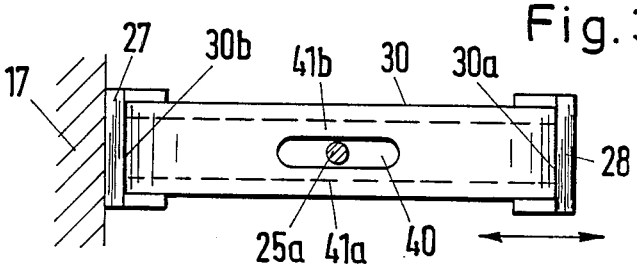
FIG. 3 is a plan view of the leaf spring journalled at both ends and mounted in the drive chamber of the fuel pump according to the invention.

The return spring 30 of the membrane is configured as a rectangular leaf spring as shown in FIG. 3. The leaf spring extends in the longitudinal direction a substantially greater length than in the direction transverse to the longitudinal direction. The leaf spring 30 has a thickness in the range of tenths of a millimeter and is made of high-quality spring steel. As shown in FIG. 1 and schematically in FIG. 3, the narrow end faces (30*a*, 30*b*) of the leaf spring 30 define its foot points which lie in abutment angles (27, 28) made of steel defining respective bearings. One of the abutment angles 27 is fixedly mounted in the housing 17 of the injection pump 10 while the other abutment angle 28 is displaceable in the longitudinal direction of the leaf spring 30 by means of an adjusting screw 29. The leaf spring 30 has a slot 40 at its mid region through which the pump piston shaft 25*a* extends. The lateral leaf spring connecting struts (41*a*, 41*b*) adjoining the slot 40 are disposed beneath the membrane plate 22*a* where they lie against the latter.

A connecting line 31 is provided in the housing 17 of the injection pump 10 and interconnects the pulse chamber 21 and the return chamber 23. A check valve 32 opening toward the pulse chamber 21 is arranged in the connecting line 31. An adjustable throttle 34 is mounted in a bypass 33 to the check valve 32 and is dimensioned for slow adjusting operations as will be described below.

Also, the return chamber 23 is connected to an adjusting volume 37 via an adjusting line 35. An adjustable throttle 36 is arranged in the adjusting line 35 and band a check valve 39 opening to the return chamber 23 is arranged in a bypass 38 arranged across the throttle 36.

The crankcase pressure is present at chamber 21 via connecting line 12. The positive pressure up with the movement of the piston 4 from top dead to bottom dead center acts on the membrane 22 whereby the . piston 25 is driven into the pump cylinder 26 and the fuel present in the pump chamber 18 is injected via the outlet 19 (FIG. 1), the injection line 20 and the injection 6 into the combustion chamber 5 of the two-stroke engine 2.

The adjustable throttle 36 is so adjusted that for idle speed and lower speeds, an almost unimpeded adjusting flow takes place from the return chamber 23 to the adjusting volume 37 so that no substantial counterpressure builds up in the return chamber 23.

After injection of the fuel, the piston 4 moves in the direction of top dead center whereby the pressure in the crankcase drops to an underpressure. The membrane 22 and the pump piston 29 are driven back to their rest position because of the action of the return spring 30 and the underpressure in the pulse chamber 21. With the upward movement of the pump piston 25, fresh fuel under feed pressure is drawn in via the intake valve 16 and the pump chamber 18 is filled.

A counterpressure is built up in the return chamber with increasing speed in order to inject a quantity of fuel adapted to the reduced air charge in the combustion chamber at high speeds of the two-stroke engine. For this purpose, the return chamber 23 is connected to the adjusting volume 37 via a throttle 36. The throttle 36 is so dimensioned that at high speed, the flow through the adjusting line 35 is restricted by the throttle so that a counterpressure is built up with each work stroke of the pump piston and the membrane 22. The more the speed increases, the higher the flow velocity in the adjusting line 35 becomes and the more effective the throttle 36 becomes, that is, the counterpressure in the return chamber 23 increases correspondingly. This counterpressure acts on the membrane 22 and generates a force opposing the actuating force in the pulse chamber 21 which reduces the piston stroke with increasing speed. In this way, a degression of the injected quantity of fuel as a function of speed is obtained in adaptation to the reduced quantity of air drawn in by suction.

The bypass is provided with a check valve 39 opening in the direction toward the return chamber 23 in order to have balanced pressure relationships at the beginning of each piston stroke and especially at high speeds. The check valve 39 assures an unthrottled adjusting flow when the membrane 22 is returned to its initial position.

The connecting line 31 from the pulse chamber 21 to the return chamber 23 is provided to ensure the injection of the needed quantity of fuel at idle and low speeds. If the crankcase is at an underpressure, then the return chamber 23 is evacuated via the check valve 32. The check valve 32 closes when the crankcase pressure changes to positive pressure values and the positive pressure is present exclusively in the pulse chamber 21. The low crankcase overpressure, which develops especially at idle, in the pulse chamber 21 is adequate to displace the pump piston 25 with the required piston stroke since the returning force of the leaf spring 30 is reduced because of the underpressure acting in the return chamber 23. Because of the negative counterpressure in the return chamber 23, a higher pressure difference for actuating the pump piston 25 is utilized when the crankcase overpressure develops.

Since the crankcase underpressure can change with the speed over time, the bypass 33 is provided with an adjustable throttle for the adjusting flows. The throttle 34 is so dimensioned that only slow adjusting flows are permitted and therefore the return chamber is adapted to the actual underpressure injection peak value (for example −0.2 bar) after several revolutions of the two-stroke engine. With this mechanism, the storage of very high occasional underpressure peaks in the return chamber 23 is prevented.

The volume of the return chamber 23 must be as small as possible and is decisive for the build-up of the desired counterpressure. The counterpressure is dependent upon the relationship between the total volume of the return chamber and the stroke volume covered over by the membrane during its stroke. If the return chamber is very large, then only small pressures are built up. On the other hand, if the return chamber is small, then large pressures are built up. The counterforce can be built up to the magnitude which provides the desired influence only when the volume is sufficiently small. With the aid of the leaf spring 30 according to a feature of the invention, the height of the return chamber 23 can be substantially reduced when compared to the required height when utilizing a helical spring.

Figure 4:
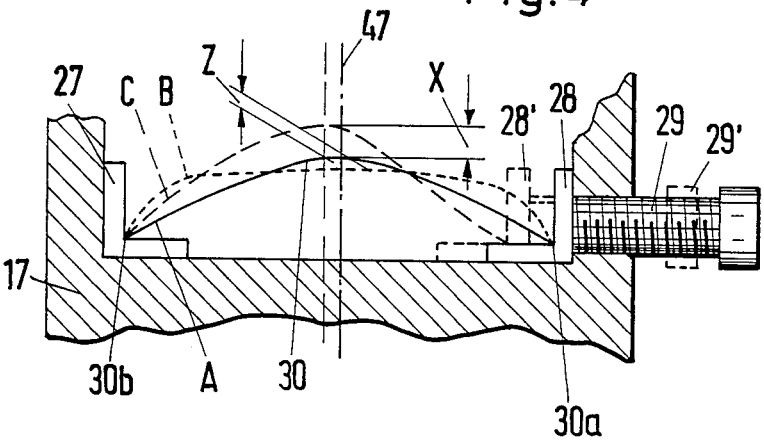
FIG. 4 is a side elevation view of the leaf spring of FIG. 3 shown for different loading conditions.

The tension of the leaf spring 30 is advantageously adjustable by changing the spacing of its braced foot points (30*a*, 30*b*). In FIG. 4, the leaf spring 30 is braced between the abutment angles 27 and 28 and is shown by the solid line A. The leaf spring 30 bends itself into the initial position shown in the direction toward the pulse chamber. The leaf spring is set in place at its two ends in the form of an arched spring. The leaf spring becomes tensioned axially and deforms according to the dotted line B with a displacement of the membrane plate by a stroke (z). Since the leaf spring can not deviate axially, very high counterforces are developed even with leaf springs having very small dimensions. The leaf spring is in contact engagement with the membrane plate at its mid longitudinal region with its remaining length being taken up in the corners by bulging as shown in FIG. 4.

If the pretension of the leaf spring 30 is to be increased, the adjusting screw 29 is rotated in the sense of a displacement of the abutment angle 28 in the longitudinal direction of the leaf spring toward the abutment angle 27 whereby a rest position of the leaf spring 30 results which is shown by the dashed line C. The abutment angle and the adjusting screw then lie in the positions 28' and 29'. The pump piston shaft 25*a* lies against housing abutment 42 in the pulse chamber 21 which determines the starting position of the membrane plate 22*a* and this starting position corresponds to the rest position of the leaf spring according to line A. For this reason, the leaf spring 30 can not take on the rest position according to line C and corresponding to the changed position 28' of the foot point 30*a*; instead, the leaf spring 30 is pressed in by an amount of the stroke x with respect to this rest position shown by line C. The leaf spring now presses the pump piston shaft 25*a* connected to the membrane plate against the housing abutment 42 with the pretensioning force corresponding to the stroke (x).

Assuming that the stroke (z) corresponds to the maximum stroke and the position 28' (shown in phantom outline in FIG. 4) of the abutment angle 28 is the maximum permitted adjustment, then the hatched region lying beneath the lines A, B and C can be filled with material of the housing whereby a further advantageous reduction of the volume of the return chamber is provided.

Hardly any transverse forces are applied to the pump piston shaft 25*a* after a bearing displacement since the pump piston shaft 25*a* extends through the leaf spring 30 in its slot 40 and is advantageously not rigidly attached to the leaf spring. An overloading of the guide of the pump piston 25 is thereby prevented. The leaf spring 30 is configured in its start position (line A) so as to be symmetrical to the longitudinal axis 47 of the pump cylinder and thereby lies substantially symmetrical to this axis even after displacement of the abutment angle 28.

Figure 5:
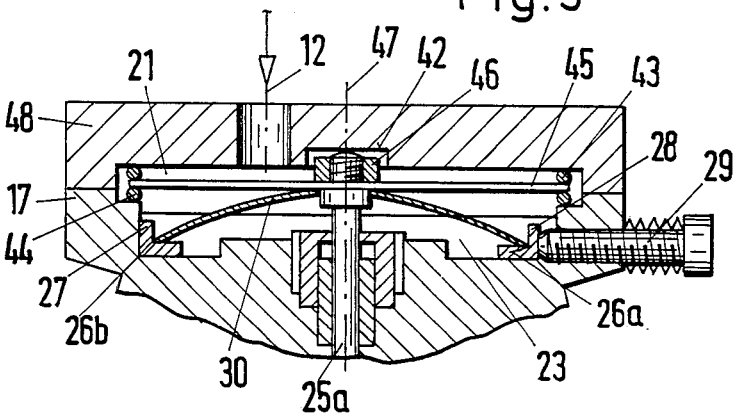
FIG. 5 is a section taken through the work chamber of the fuel pump according to another embodiment of the invention with the fuel pump having a steel membrane.

In a further embodiment of the invention shown in FIG. 5, the membrane and the membrane plate are replaced by a very thin spring steel membrane 45 which is tightly held at its outer periphery between two sealing rings 43 and 44. The sealing rings 43 and 44 are disposed in an annular slot which is provided between the housing 17 and the housing cover 48. A stationary abutment 42 in the housing cover 48 is provided for the end of the pump piston shaft 25*a* lying in the work chamber.

The steel membrane has resilient characteristics and thereby provides a counterforce increasing with the stroke. The adaptation of the counterforce increasing with the stroke occurs via the leaf spring 30 (shown in dashed outline in FIG. 4) which now can be configured so as to be substantially smaller because the primary portion of the counterforce is developed by the steel membrane 45. The force to be developed by the leaf spring 30 now lies in the order of magnitude required for the adjustment.

Figure 6:
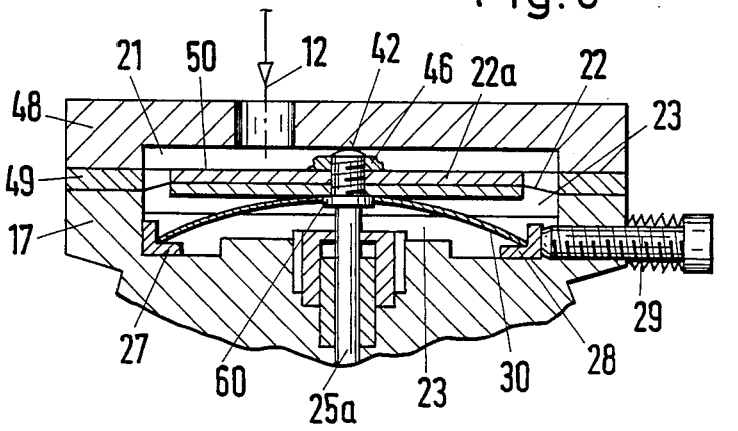
FIG. 6 is a section through the work chamber of a fuel pump according to still another embodiment of the invention wherein an additional flat spring is mounted in the pulse chamber; and, FIG. 7 is a plan view of the flat spring shown in FIG. 6.
Figure 7:
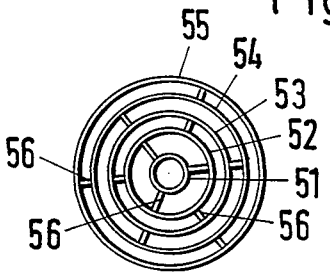

The embodiment of FIG. 6 corresponds to that shown in FIG. 1 wherein only an additional round flat spring 50 is mounted in the pulse chamber. A possible embodiment of this flat spring is shown in plan view in FIG. 7. This flat spring is comprised essentially of concentric rings 51 to 55 lying one inside the other with each two mutually adjacent ones of the rings being interconnected by struts 56.

This flat spring lies preferably against the membrane plate 22*a* and is fixed with its inner ring 51 between the membrane plate 22*a* and a nut 60 threadably engaged with the pump piston shaft 25*a*. The outer ring 55 of the flat spring is tightly clamped between the intermediate ring 49 and the housing cover 48 of the injection pump housing. The flat spring is so dimensioned that it provides the primary portion of the compensating counterforce which increases with the stroke so that the leaf spring 30 mounted in the return chamber 23 can be configured so as to be narrower. The narrower embodiment of the leaf spring 30 is shown in dashed outline in FIG. 3. The solid lines shown in FIG. 3 indicate the width of the leaf spring necessary in the configuration shown in FIGS. 1 and 2, since in the embodiment shown in FIGS. 1 and 2, the leaf spring must provide the entire compensating counterforce. The narrow leaf spring 30 for the embodiment of FIG. 6 must only be so dimensioned that it develops the force difference defined by the adjusting range.

The leaf spring 30 can be arranged in combination with a helical spring for special situations with the leaf spring 30 providing the primary portion of the counterforce and the helical spring providing only the force difference required for making the adjustment with this force difference being between a maximum allowable and a minimum required counterforce.

It is understood that the foregoing description is that of the preferred embodiments of the invention and that various changes and modifications may be made thereto without departing from the spirit and scope of the invention as defined in the appended claims.

What is claimed is:

1. A fuel injection pump for a two-stroke engine, especially for handheld portable tools such as motor-driven saws or the like, the engine having a piston and a cylinder conjointly defining a combustion chamber and having a crankcase wherein pressure is developed in response to the movement of the piston, the fuel injection pump comprising:

a housing defining an enclosed work space;

a membrane partitioning said work space into a pulse chamber and a return chamber;

a pump chamber arranged in said housing;

fuel supply means connected to said pump chamber for supplying fuel to the latter;

fuel metering line means for conducting the fuel from said pump chamber to the engine;

a pump cylinder communicating with said pump chamber;

a pump piston connected to said membrane and being slideably mounted in said cylinder so as to be reciprocally movable through a piston stroke away from a start position and back to said start position;

a connecting line connecting said pulse chamber to the crankcase for charging said pulse chamber with the pressure present in the crankcase for actuating said membrane to develop an actuating force for driving said pump piston into said pump chamber to pump the fuel therein through said fuel metering line means and withdrawing said pump piston away from said pump chamber to draw in a fresh quantity of fuel from said fuel supply means;

counterpressure means for generating a counterpressure in said return chamber for changing said piston stroke in dependence upon the rotational speed of the engine thereby changing the quantity of fuel pumped from said pump chamber; and, leaf spring means arranged in said return chamber for resiliently biasing said pump piston toward said start position.

2. The fuel injection pump of claim 1, said counterpressure means comprising: adjusting volume for receiving a flow of air; an adjusting line connecting return chamber to said adjusting volume means; and, the means mounted in said adjusting line for throttling a adjusting flow therethrough so as to permit a to develop in said return chamber for acting count to said actuating force.

3. The fuel injection pump of claim 1, said leaf spring means being a narrow strip-like leaf spring arranged to extend diagonally across said return chamber beneath said membrane; and, said leaf spring having end faces defining respective foot points braced in said housing.

4. The fuel injection pump of claim 3 comprising: displacing means for displacing at least one of said foot points in the longitudinal direction of said leaf spring toward the other one of said foot points.

5. The fuel injection pump of claim 4, said displacing means comprising an adjusting screw threadably engaging said housing so as to impart a displacing movement to said one foot point.

6. The fuel injection pump of claim 3, comprising abutment angles mounted in said return chamber and defining bearings for receiving respective ones of said foot points therein.

7. The fuel injection pump of claim 4, said pump piston defining a longitudinal piston axis; said leaf spring having a starting position before being displaced by said displacing means; and, said leaf spring being configured so as to be symmetrical vis-a-vis said piston axis.

8. The fuel injection pump of claim 4, said leaf spring having a mid portion in displaceable contact engagement with said membrane.

9. The fuel injection pump of claim 3, said leaf spring having a mid portion with a symmetrical slot formed therein; said piston being mounted in said housing so as to extend through said slot and into said pump cylinder.

10. The fuel injection pump of claim 1, comprising a flat spring disposed in said pulse chamber and being connected to said piston, said flat spring having a peripheral edge fixedly connected to said housing.

11. The fuel injection pump of claim 1, said membrane being a thin spring steel membrane.

12. The fuel injection pump of claim 2, said adjusting volume being an enclosed space formed in said housing.

13. The fuel injection pump of claim 1, said counterpressure means comprising: an adjusting line connecting said return chamber to the atmosphere; and, throttle means mounted in said adjusting line for throttling a rapid adjusting flow through said adjusting line.

14. The fuel injection pump of claim 2, said throttle means including adjusting means for adjusting the throttling action in said adjusting line.

* * * * *

UNITED STATES PATENT AND TRADEMARK OFFICE

CERTIFICATE OF CORRECTION

PATENT NO. : 4,846,119

DATED : July 11, 1989

INVENTOR(S) : Werner Geyer and Roland Schierling

It is certified that error appears in the above-identified patent and that said Letters Patent is hereby corrected as shown below:

On the title page, under "References Cited": delete "4,765,802 10/1973 Lettermann et al . . ." and substitute -- 3,765,802 10/1973 Lettermann et al . . . -- therefor.

In column 2, line 65: delete "a".

In column 3, line 46: delete "a" and substitute -- the -- therefor.

In column 4, line 16: insert -- EMBODIMENTS -- between "PREFERRED" and "OF".

In column 4, line 20: delete "in" and substitute -- is -- therefor.

In column 4, line 35: delete "pup 10" and substitute -- pump 10 -- therefor.

In column 4, line 39: insert -- injection -- after "fuel", second occurrence.

In column 4, line 59: delete "defining" and substitute -- define -- therefor.

In column 5, line 32: delete "band".

UNITED STATES PATENT AND TRADEMARK OFFICE

CERTIFICATE OF CORRECTION

PATENT NO. : 4,846,119

DATED : July 11, 1989

INVENTOR(S) : Werner Geyer and Roland Schierling

It is certified that error appears in the above-identified patent and that said Letters Patent is hereby corrected as shown below:

In column 5, line 36: insert -- built -- between "pressure" and "up".

In column 5, line 37: insert -- center -- between "dead", first occurrence, and "to".

In column 5, line 38: delete the period after "the", second occurrence, and substitute -- pump -- therefor.

In column 5, line 40: insert -- valve -- between "outlet" and "19".

In column 5, line 41: insert -- nozzle -- between "injection" and "6".

In column 9, line 10: insert -- means -- between "volume" and "for".

UNITED STATES PATENT AND TRADEMARK OFFICE

CERTIFICATE OF CORRECTION

PATENT NO. : 4,846,119

DATED : July 11, 1989

INVENTOR(S) : Werner Geyer and Roland Schierling

It is certified that error appears in the above-identified patent and that said Letters Patent is hereby corrected as shown below:

In column 9, line 11: insert -- said -- between "connecting" and "return".

In column 9, line 13: insert -- throttle -- before "means".

In column 9, line 13: insert -- rapid -- after "a".

In column 9, line 14: insert -- counterpressure -- between "a" and "to", second occurrence.

In column 9, line 15: delete "count" and substitute -- counter -- therefor.

Signed and Sealed this

Fifteenth Day of May, 1990

*Attest:*

HARRY F. MANBECK, JR.

*Attesting Officer*

*Commissioner of Patents and Trademarks*